United States Patent [19]

Zmoda

[11] 4,084,939

[45] Apr. 18, 1978

[54] AUDIBLY BURNING GELLED ALCOHOL

[75] Inventor: Barney J. Zmoda, Bridgewater, N.J.

[73] Assignee: Colgate-Palmolive Company, New York, N.Y.

[21] Appl. No.: 753,241

[22] Filed: Dec. 22, 1976

[51] Int. Cl.[2] ..... C10L 7/04

[52] U.S. Cl. ..... 44/7 C; 44/7 D

[58] Field of Search ..... 44/7 A, 7 C, 7 D, 7 B

[56] References Cited

U.S. PATENT DOCUMENTS

| | | | |
|---|---|---|---|
| 3,183,068 | 5/1965 | Monick | 44/7 B |
| 3,461,006 | 8/1969 | Fay et al. | 44/7 C |
| 3,516,941 | 6/1970 | Matson | 44/7 D |
| 3,565,559 | 2/1971 | Sato et al. | 44/7 D |
| 3,754,877 | 8/1973 | Klug | 44/7 C |
| 3,759,674 | 9/1973 | Gregg | 44/7 C |
| 3,801,292 | 4/1974 | Tanner | 44/7 C |

*Primary Examiner*—Edward A. Miller
*Attorney, Agent, or Firm*—Norman Blumenkopf; Murray M. Grill; Herbert S. Sylvester

[57] ABSTRACT

A gelled alcohol charcoal lighter that burns with an audible crackling noise to give a distinct indication that the fuel is burning although flames may be colorless and not apparent to the eye. The gelled composition contains a major proportion of at least one lower alcohol, a gelling agent and a minor proportion of rigid, organic capsules containing a volatile solvent which emit a popping sound as each capsule ruptures from the heat of the flame.

13 Claims, No Drawings

AUDIBLY BURNING GELLED ALCOHOL

BACKGROUND OF THE INVENTION

The present invention relates to gel compositions, and, more particularly, to fuel gel compositions.

Charcoal lighter fuel gel compositions are known. However, many of the fuel gels available, while having good properties of combustion, present serious drawbacks, especially in regard to safe, non-hazardous utilization. For example, many of the presently known fuel gels burn with a smoky flame and the formation of soot. Some of the gels give off highly poisonous fumes. Others burn with a non-luminous flame and it is extremely difficult to see that combustion is taking place, particularly in sunlight, thereby increasing the possibility of injury from burns. Moreover, many of the known fuel gels leave a relatively large malodorous residue after burning. In addition, some of the known fuel gels break down during burning and, therefore, exhibit poor combustion properties. There exists an obvious need to provide a fuel gel charcoal lighter which overcomes these serious drawbacks.

SUMMARY OF THE INVENTION

It has now been discovered that the addition of rigid, brittle, organic capsules in a several hundred micron size, containing a volatile solvent, can serve as an audible indicator that fuel gel lighter is burning. The effect is a small popping sound as each capsule ruptures from the heat of the flame, sounding in a rapid, but irregular, succession. This popping as the capsules rupture generally continues until all the gel is burned away.

The capsules for use in the present invention must be impermeable to the volatile materials encased therein, as well as to the gelled alcohols in which the capsules are dispersed. In order that the capsules rupture when the volatile materials encased therein are heated, the encapsulating material must not melt at the burning temperatures of the gelled alcohols.

Additionally, it is preferred that the encapsulating material, which forms the shell wall of the capsule, be only a minor proportion, e.g., less than 25% by weight, of the total weight of the capsule. Sufficient encapsulating material must be present to form a capsule which will not rupture until burning temperatures are reached, but it is preferable to have as much of the capsule as possible given to volatile solvent in order to provide an audible popping noise at burning temperatures.

The capsules for use in the present invention preferably have approximately the same density as the gelled alcohols into which they are incorporated. This property enables the capsules to remain in suspension in the gel without floating to the top or sinking to the bottom. Additionally, when the capsules have a density approximating that of the gel, the capsules can be easily dispersed in the gel simply by mixing the capsules and the gel, without the addition of suspending agents.

The capsules for use in compositions according to the present invention range in size from about 50 microns to about 900 microns, with about 50% of the capsules being from 300 to 500 microns in diameter, and have an organic outer shell. The encapsulated material need not be flammable, but it must be of sufficient volatility that, at temperatures at which the alcohol gel burns, the material will volatilize and rupture the capsule to provide a popping sound. Although flammable materials are preferred, they are not essential. Among materials which create the popping effect when encapsulated and dispersed throughout a fuel gel are xylene, kerosene, mineral spirits, naphtha and volatile chlorinated hydrocarbon solvents.

Preferred capsules for use in the compositions according to the present invention are LJTW-353, a xylene encapsulated in a modified gelatin available from Capsular Products Division, National Cash Register Co., comprising 85% by weight of xylene and 15% by weight of shell. Encapsulated kerosene is also suitable. Other capsules which could be used in compositions of the present invention are those disclosed in Matson, U.S. Pat. No. 3,516,941, such as flammable petroleum distillate encapsulated in a urea-formaldehyde polymer. Additional capsules that may be used are those disclosed in Eichel, U.S. Pat. No. 3,317,433, heat-rupturable capsules of a minute size.

The microcapsules are present in the gelled alcohol compositions of the present invention in amounts ranging from about 0.1% to about 10% by weight.

It has been found that alcohols gelled with dispersions of ethylene-acrylic acid copolymers, with or without the addition of a small amount of carboxy vinyl polymers, work best in incorporating the microcapsules in the compositions according to the present invention.

The most suitable ethylene-acrylic acid copolymer dispersions for use in this invention are those described in Gregg, U.S. Pat. No. 3,759,674, which disclosure is herein incorporated by reference. These aqueous dispersions comprise from 10 to 20 parts by weight of an ethylene-acrylic acid copolymer wax having an acid number in the range of about 50 to about 80, and from 3 to 4 parts by weight of an amine emulsifier, i.e., diethylaminoethanol or morpholine, and sufficient water so that the resulting dispersion contains from about 10 to about 30% by weight of solids. Up to equal parts of the copolymer wax of another inert wax, having a melting point up to about 130° C., is also present. A preferred gel composition is disclosed in Example 6 of the above-identified Gregg patent.

The ethylene-acrylic acid copolymer waxes useful in the present invention are low molecular weight waxes of ethylene copolymerized with acrylic acid. The copolymer wax constituent of the present dispersion can be a single copolymer having an acid number within the required range or a mixture of such copolymers having varying acid numbers and an average acid number within the required range.

In addition, conventional waxes can also be added in preparing the dispersions to lower costs. Suitable waxes have melting points up to about 130° C. and include paraffin waxes, generally those having melting points in the range of about 125 to 175° F., microcrystalline waxes, Fisher-Tropsch-type waxes, carnauba wax, beeswax and the like. Paraffin waxes are readily available and inexpensive. These waxes can be added in amounts up to the weight of the ethylene-acrylic acid copolymer present.

The present dispersions are prepared by heating the ethylene-acrylic acid copolymer, other waxes if employed, and amine emulsifier to a temperature from about 100 to 140° C., preferably about 120 to 125° C., but above the melting point of the wax component and adding the wax mixture to water preheated to a temperature of from 80° to 100° C., while stirring vigorously. The resulting dispersion is then cooled to room temperature to form a stable dispersion. Dispersions containing a high proportion of ethylene-acrylic acid copolymer are quite clear, whereas more translucent dispersions are formed with increasing proportions of other waxes in the mixture.

The ethylene-acrylic acid copolymer dispersions are present in the gelled alcohol compositions in amounts ranging from about 5% to about 35% by weight of the total composition.

Small amounts of carboxy vinyl polymer gelling agents may also be incorporated in the gelled alcohol compositions according to the present invention. The carboxy vinyl polymers employed are generally synthetic mucilaginous hydrophilic substances which preferably contain carboxylic salt groups. It is preferred to use cross-linked polymers which are produced by the polymerization or intermolecular reaction of two or more different monomers containing polyfunctional groups. The term polymer includes, therefore, copolymers. Suitable examples of such polymers are disclosed in British patent specification No. 799,951, published Aug. 13, 1958, and U.S. Pat. No. 2,798,053, granted July 2, 1957, which patents are herein incorporated by reference. The polymers disclosed therein are compositions comprising a cross-linked interpolymer of (a) a monoolefinic monomeric material comprising at least 25% by weight of a monomeric olefinically-unsaturated carboxylic acid containing at least one activated carbon to carbon double bond such as acrylic acid, and (b) from about 0.01% to 10.0% by weight of a polyunsaturated cross-linking agent containing a plurality of polymerizable vinyl or crotyl groups such as a polyalkenyl polyether of a polyhydric alcohol. More particularly, the preferred interpolymers are derived from a mixture of acrylic acid and a polyether of sucrose in which the hydroxyl groups are modified are etherified with at least two allyl groups per molecule. A specific example of such a material is one containing about 97.5% to 99.8% by weight of a monomeric polyether of sucrose in which the hydroxyls are etherified with at least two, and preferably about five to about six, allyl groups per sucrose molecule. Such carboxylic polymers are available commercially in the free acid form and neutralized by the presence of a weak amine base contained in the composition and defined hereinbelow. As stated heretofore, these carboxy vinyl polymers are employed in minor amounts in the new compositions of this invention. Moreover, they are employed by direct addition to the alcohol or alcohol mixtures or they can be employed in water solutions or dispersions, the preferred amounts used being about 0.1% to about 1.0% by weight of the total composition.

Generally any weak amine base can be used in preparing the new composition of this invention in order to neutralize the carboxy vinyl polymers defined above. Although the weight percent amount of any particular amine compound employed should be enough to completely neutralize the acidic polymer and is preferably equal by weight to the weight of polymer present in the composition, greater or lesser amounts can usefully be present in the composition so long as the amount present is substantially completely utilized for neutralization of the acidic polymer. Among the preferred amines which are useful in preparing the new fuel gel composition of the invention are the mono-, di- and tri-aliphatic amines containing from 1 to about 8 carbon atoms in the aliphatic carbon chain and wherein the substituent group can be the same or different in the di- and tri-compounds. However, the amines containing one or more aliphatic groups containing 3 to 8 carbon atoms are especially preferred. Among such compounds are mono-, di- and tri-methyl, ethyl, propyl, butyl, amyl, hexyl amines and the like. A particularly effective amine is di-2-ethylhexyl amine. It is to be noted that the terminology "weak amine base" is also intended to include alkylolamines containing from 1–8 carbon atoms in the alkyl group. Such compounds include the mono-, di- and tri-methanolamines, ethanolamines, propanolamines, etc., and the like. The amine base is generally present in amounts ranging from about 25% to about 100% by weight of the carboxy vinyl polymer present in the composition.

The low molecular weight alcohols which can be employed in the compositions of the present invention are those containing from 1 to 6 carbon atoms, such as ethanol, propanol, isopropanol, butanol, isobutanol, hexanol and the like. These alcohols can be employed along or in mixture with each other. Although ethyl alcohol alone forms an excellent combustible gel, it burns with a substantially non-luminous flame. Accordingly, it is preferred that one of the other alcohols, that is, the 3–6 carbon alcohols, be utilized therewith when luminosity is desired. In such a mixture, the alcohol used with ethyl alcohol is generally present in an amount of about 20% to 40% by weight, based on the total weight of the composition. Commercial ethyl alcohol containing such relatively innocuous substances as brucine and brucine sulfates, which are complex alkaloids, or denaturants are preferred in preparing gel fuels in accordance with the present invention. However, ethyl alcohol containing other known denaturants can also be used. On the other hand, the 3 to 6 carbon atom alcohols when used alone normally provide both excellent properties of combustibility, as well as luminosity. As pointed out hereinabove, the alcohols are employed in a major amount. However, the total amount of alcohol or mixtures thereof can vary widely so long as such amount accounts for the major ingredient in the composition. Preferably, however, the total alcoholic content in the new fuel gel of this invention is in a range of about 40 to 90% by weight, based on the total weight of the composition, compositions containing from about 55% to 75% being preferred. It is to be noted, however, that the optimum amount of alcohol or alcohol mixtures for any particular fuel gel can be determined by routine tests.

When the requirements relating to the production of soot are less stringent, other combustible fuels, for example, hydrocarbons such as benzol, gasoline, mineral spirits and certain oxygenated compounds, such as ketones having up to six carbon atoms, e.g., acetone, methyl-ethyl ketone, and the like can be used, although the production of soot will be to an undesirable degree for some purposes. When sooting is a stringent limitation, ketones having not more than three to four carbon atoms can be used. While the ketones have been considered hereinbefore as auxiliary fuels, the lower ketones such as acetone and methyl-ethyl ketone are primarily solvent boosters or solvents for the nitrocellulose. Accordingly, the ketones, especially the ketones having three and four carbon atoms, are considered to be auxiliary solvents rather than auxiliary fuels. Since the other combustible fuels, benzol, gasoline and the like are non-polar in nature and tend to separate from the remainder of the composition, they are usually present in relatively small amounts, preferably up to about ten percent by weight of the composition although this limitation is not critical. Greater amounts of the non-polar compounds(s) can be present provided the stability and combustibility of the final composition is not adversely affected. Thus, the preferred ketones can be present as solvents to the extent of five to ten percent of the composition of the sol. Additional auxiliary fuels include kerosene, paraffinic and isoparaffinic solvents.

The compositions of the invention can also have optional constituents incorporated therein. Such constituents include dyes, and other adjuvants, such as perfumes, various ash-reducing compositions such as alkali metal salts, e.g., sodium and potassium salts of nitrates, chlorates and the like. One particularly useful ash-reducing composition is sodium nitrate which may be employed as an aqueous solution to the extent of 0.5 – 1.5 percent preferably 0.5 to 1 percent, solids by weight based on the total composition. The other optional ingredients are normally present in the compositions in amounts of 0.5 percent each or less.

DETAILED DESCRIPTION OF THE INVENTION

EXAMPLE I

A charcoal lighter gel was prepared from the following ingredients:

| | % by weight |
|---|---|
| Isopropanol | 21.87 |
| Ethanol | 53.80 |
| Bitrex* (0.22 ethyl alcohol solution) | 1.00 |
| Fuchsine (1% ethyl alcohol solution)dye | 0.03 |
| Carboxy vinyl polymer** | 0.20 |
| Di-(2 ethylhexyl) amine | 0.10 |
| Encapsulated xylene*** | 3.00 |
| Ethylene-acrylic acid copolymer dispersion (Example 6 of Gregg, U.S. Pat. No. 3,759,674) | 20.00 |

*denaturant - benzyl diethyl (2,6-xylyl carbamoyl methyl) ammonium benzoate
**99% glacial acrylic acid, 1% polyallyl sucrose of 5-6 allyl groups per sucrose molecule
***encapsulated in modified gelatin: 85% xylene, 15% encapsulating material, ranging from 50 to 900 microns in size The above gel burned with distinct crackling noise which served as a distinct indication that the fuel was burning. Some incandescence was created by the xylene's burning.

EXAMPLE II

A charcoal lighter gel was formed from the following ingredients:

| | % by weight |
|---|---|
| Isopropanol | 21.87 |
| Carboxyvinyl polymer of Example I | 0.2 |
| Ethanol | 54.80 |
| Bitrex (0.22% solution) | 2.0 |
| Dye | 0.03 |
| di(2 ethyl hexyl) amine | 0.10 |
| Encapsulated xylene of Example I | 1.00 |
| Ethylene-acrylic acid copolymer dispersion of Example I | 20.00 |

The above-described composition formed a good gel.

A pyramid of charcoal briquets 4–5 coals wide and 5–6 coals high was formed across the width of a brazier. This pyramid served as a base for fires. The weather was windy and clear. The composition of Example II was applied to the briquets and a match applied. The beads exploded audibly to indicate that the gel was burning, and the briquets readily caught fire.

EXAMPLE III

A charcoal lighter gel was made from the following:

| | % by weight |
|---|---|
| Isopropanol | 21.87 |
| Carboxyvinyl polymer of Example I | 0.20 |
| Ethanol | 53.80 |
| Bitrex (0.22% solution) | 1.00 |
| Dye | 0.03 |
| Di(ethyl hexyl) amine | 0.10 |
| Kerosene encapsulated in modified gelatin: 85% kerosene, 15% modified gelatin | 3.00 |
| Ethylene-acrylic acid copolymer dispersion of Example I | 20.00 |

EXAMPLE IV

A charcoal lighter gel was made from the following:

| | % by weight |
|---|---|
| Isopropanol | 20 |
| Water | 10 |
| Kerosene | 10 |
| Bitrex (0.22% solution) | 1 |
| Ethanol | 47 |
| Collodion | 6 |
| Encapsulated xylene of Example I | 1 |
| Ethylene-acrylic acid copolymer dispersion of Example I | 5 |

This composition formed a very good gel which clung to the charcoal briquets when burning and did not run off from the briquets. The gel burned well with audible popping.

EXAMPLE V

A charcoal lighter gel was made from the following:

| | % by weight |
|---|---|
| Isopropanol | 20 |
| Water | 10 |
| Kerosene | 10 |
| Bitrex (0.22% solution) | 1 |
| Dye | 0.03 |
| Ethanol | 46.87 |
| Collodion | 6.0 |
| Encapsulated xylene of Example I | 1.0 |
| Ethylene-acrylic acid copolymer dispersion of Example I | 5.0 |

The above composition formed a thixotropic gel.

EXAMPLE VI

A charcoal lighter gel was made from the following ingredients:

| | % by weight |
|---|---|
| Isopropyl alcohol | 25.0 |
| Carboxy vinyl polymer of Example I | 0.2 |
| Ethanol | 40.27 |
| Bitrex (0.22% solution) | 1.0 |
| Dye | 0.03 |
| Encapsulated xylene of Example I | 0.5 |
| Ethylene-acrylic acid copolymer dispersion of Example I | 22.0 |
| Kerosene | 10.0 |

Burn tests were conducted with the compositions of Examples V and VI on a sunny day with a constant high breeze. New charcoal briquets were piled in four piles from one side of the brazier to the other, each pile about 5 inches high and 8 inches wide. Each gel was squirted under and between the briquets and the briquet piles lighted one at a time to observe the flame.

The composition of Example V burned with a very obvious yellow-orange flame and exhibited neither smoke nor odor. The crackling of the encapsulated xylene was prominent.

The composition of Example VI burned with a very obvious yellow-orange flame, and exhibited no smoke and no odor. The crackling of the beads was prominent. The gel burned well. The charcoal was well ignited.

EXAMPLE VII

A charcoal lighter gel was made from the following ingredients:

| | % by weight |
|---|---|
| Isopropyl alcohol | 19.85 |
| Carboxy vinyl polymer of Example I | 0.2 |
| Ethanol | 37.85 |
| Bitrex (0.22% solution) | 1.0 |
| Di-(2-ethylhexyl) amine | 0.1 |
| Encapsulated xylene of Example I | 3.0 |
| Ethylene-acrylic acid copolymer dispersion of Example I | 23.0 |
| Isopar M* | 15.0 |

*isoparffinic solvent — b.p. range 410° F. flash point 175° F.

The carboxy vinyl polymer was first wetted with Isopar M, and then dissolved in the ethanol. The remaining ingredients were then added, with constant stirring. A good gel was formed.

EXAMPLE VIII

A charcoal lighter gel was made from the following ingredients, according to the method of Example VII:

| | % by weight |
|---|---|
| Isopar-M | 15.0 |
| Carboxy vinyl polymer of Example I | 0.2 |
| Ethanol | 37.85 |
| Bitrex (0.22% solution) | 1.0 |
| Isopropanol | 19.95 |
| Encapsulated kerosene in modified gelatin 85% kerosene, 15% modified gelatin | 3.0 |
| Ethylene-acrylic acid copolymer dispersion of Example I | 23.0 |

The above composition, when initially formulated, set very slowly and was quite fluid. However, within 12 hours a good gel was formed.

EXAMPLE IX

A charcoal lighter gel was made from the following ingredients, according to the method of Example VII:

| | % by weight |
|---|---|
| Isopropanol | 25.95 |
| Carboxy vinyl polymer of Example I | 0.2 |
| Ethanol | 32.85 |
| Bitrex (0.22% solution) | 1.0 |
| Encapsulated xylene of Example I | 3.0 |
| Ethylene-acrylic acid copolymer dispersion of Example I | 22.0 |
| Isopar-M | 15.0 |

A good gel was formed even before all of the Isopar-M was added to the mixture.

EXAMPLE X

A charcoal lighter gel was made from the following ingredients, according to the method of Example VII.

| | % by weight |
|---|---|
| Isopropanol | 26.0 |
| Carboxy vinyl polymer of Example I | 0.2 |
| Ethanol | 32.8 |
| Bitrex (0.22% solution) | 1.0 |
| Encapsulated xylene of Example I | 3.0 |
| Ethylene-acrylic acid copolymer dispersion of Example I | 22.0 |
| Isopar-M | 15.0 |

EXAMPLE XI

A charcoal lighter having fairly good gelling properties was made from the following ingredients:

| | % by weight |
|---|---|
| Carboxy vinyl polymer of Example I | 0.25 |
| Ethanol | 30.9 |
| Bitrex (0.22% solution) | 1.0 |
| Di-(2-ethylhexyl) amine | 0.05 |
| Isopropanol | 31.8 |
| Encapsulated xylene of Example I | 3.0 |
| Ethylene-acrylic acid copolymer dispersion of Example I | 23.0 |
| Isopar-M | 10.0 |

EXAMPLE XII

A thixotropic gel was made from the following ingredients which were added in the following order:

| Part I | % by weight |
|---|---|
| Ethanol | 89.2857 |
| Collodion Base Mix | 10.7143 |

| Part II | % by weight |
|---|---|
| Isopropyl Alcohol | 24.1975 |
| Bitrex (0.22% solution) | 0.0022 |
| Klucel H* | 0.3000 |
| Part I Collodion Solution | 56.0000 |
| Kerosene | 8.5000 |
| Fuschine Dye | 0.0003 |
| Encapsulated Xylene of Example I | 0.5000 |
| Gasoline | 0.5000 |

*Hydroxypropyl cellulose available from Hercules, Inc.

The above ingredients were mixed at high shear and formed a thixotropic gel dispersible from a narrow-orifice squeeze bottle.

What is claimed is:

1. A stable, audibly burning, alcohol gel composition comprising a major proportion of at least one aliphatic monohydroxy alcohol, a gelling agent, and a minor proportion of rigid, organic capsules containing a volatile solvent.

2. The composition of claim 1 wherein the alcohol constitutes about 65 to about 80 percent of the total weight of the composition.

3. The composition of claim 1 wherein the alcohol has from two to six carbon atoms in the molecule.

4. The composition of claim 1 containing up to ten percent of at least one auxiliary fuel.

5. The composition of claim 1 wherein the volatile solvent is xylene.

6. The composition of claim 1 wherein the volatile solvent is kerosene.

7. The composition of claim 1 wherein the gelling agent comprises a major proportion of an ethylene-acrylic acid copolymer dispersion and a minor proportion of a carboxy vinyl polymer.

8. The composition of claim 7 wherein the volatile solvent is xylene.

9. The composition of claim 7 wherein the volatile solvent is kerosene.

10. The composition of claim 1 wherein the capsules range in size from about 50 microns to about 900 microns in diameter.

11. A stable alcohol gel composition comprising:

| Component: | Weight Percent |
|---|---|
| Aliphatic alcohol of 1 to 4 carbons | 40–90 |
| Carboxy vinyl polymer | 0.1–2.0 |
| Encapsulated volatile solvent | 0.1–10 |
| Ethylene-acrylic acid copolymer dispersion | 5–34 |
| Dyes, denaturants | Balance to make 100% |

12. The composition of claim 11 comprising 75% aliphatic alcohol, 0.2% carboxy vinyl polymer, 3% encapsulated volatile solvent and 20% ethylene-acrylic acid copolymer dispersion.

13. The composition of claim 12 wherein the volatile solvent is xylene.

* * * * *